US005713287A

United States Patent [19]

Gelbart

[11] Patent Number: 5,713,287

[45] Date of Patent: Feb. 3, 1998

[54] DIRECT-TO-PRESS IMAGING METHOD USING SURFACE MODIFICATION OF A SINGLE LAYER COATING

[75] Inventor: Daniel Gelbart, Vancouver, Canada

[73] Assignee: Creo Products Inc., Burnaby, Canada

[21] Appl. No.: 490,361

[22] Filed: Jun. 14, 1995

Related U.S. Application Data

[63] Continuation-in-part of Ser. No. 438,817, May 11, 1995, abandoned.

[51] Int. Cl.[6] ..... B41N 1/14

[52] U.S. Cl. ..... 101/467; 101/478

[58] Field of Search ..... 101/453, 456, 101/457, 460, 462, 463.1, 465–467, 470, 471, 478, 401.1

[56] References Cited

U.S. PATENT DOCUMENTS

| | | | |
|---|---|---|---|
| 2,764,085 | 9/1956 | Shoemaker, et al. | 101/467 |
| 3,168,864 | 2/1965 | Brandl Jr., et al. | 101/467 |
| 3,422,759 | 1/1969 | Brynko et al. | 101/467 |
| 3,678,852 | 7/1972 | Feinleib et al. | 101/467 |
| 3,741,118 | 6/1973 | Carley | 101/451 |
| 4,063,949 | 12/1977 | Uhlig et al. | 101/471 |
| 4,718,340 | 1/1988 | Love | 101/116 |
| 4,743,091 | 5/1988 | Gelbart | 350/252 |
| 4,833,990 | 5/1989 | Hirt et al. | 101/467 |
| 5,102,771 | 4/1992 | Vogel | 430/270 |
| 5,126,760 | 6/1992 | DeBoer | 346/108 |
| 5,129,321 | 7/1992 | Fadner | 101/467 |
| 5,225,316 | 7/1993 | Vogel | 430/270 |
| 5,278,027 | 1/1994 | Clarke | 430/307 |
| 5,314,785 | 5/1994 | Vogel | 430/269 |
| 5,339,737 | 8/1994 | Lewis | 101/454 |
| 5,378,580 | 1/1995 | Leenders | 430/303 |
| 5,385,092 | 1/1995 | Lewis, et al. | 101/467 |

FOREIGN PATENT DOCUMENTS

| | | | |
|---|---|---|---|
| 1050805 | 3/1979 | Canada . | |
| 652483 | 5/1995 | European Pat. Off. . | |
| 2524701 | 12/1976 | Germany | 101/467 |
| 92575 | 4/1990 | Japan | 101/467 |
| 07716 | 5/1992 | WIPO . | |

OTHER PUBLICATIONS

*Print World*, vol. 230, No. 4, (Apr. 25, 1990).

*Primary Examiner*—Stephen R. Funk
*Attorney, Agent, or Firm*—Steven G. Lisa

[57] ABSTRACT

A direct-to-press system using a seamless cylinder coated on the press with a curable polymer. After curing, the surface of the polymer is modified by selective laser radiation to change its affinity to printing ink. The cylinder is used in place of a plate cylinder in an offset press, either conventional or waterless. Since only the surface is selectively modified by the laser, coating thickness and uniformity are of little concern. After printing, the cylinder is cleaned on the press using a cleaning station similar to blanket washers used on presses. Cleaning does not have to be complete since the surface of the cylinder is never exposed to the ink. The system is compatible with existing press designs as it can be mounted in the space currently used to access the plate cylinder for plate changing.

60 Claims, 3 Drawing Sheets

DIRECT-TO-PRESS IMAGING METHOD USING SURFACE MODIFICATION OF A SINGLE LAYER COATING

RELATED APPLICATION

This application is a continuation-in-part of U.S. patent application Ser. No. 08/438,817, filed May 11, 1995, now abandoned.

FIELD

The present invention relates to direct-to-press imaging lithographic printing presses in which printing images are formed on a printing cylinder used in printing operations.

BACKGROUND

In accordance with conventional lithographic printing practices, ink in desired image patterns is formed on a plate that is clamped to a plate cylinder. The inked image pattern is ordinarily transferred from the surface of the plate to a blanket cylinder having a compressible surface. From the blanket cylinder the image is impressed onto paper. The printing plate carries a differentiated image on a dimensionally stable substrate such as an aluminum sheet. The imaged aluminum plate is secured to the plate cylinder by a mechanical lock-up mechanism which defines positional registration between the plate and the surface of the cylinder. When new images are to be printed, the mechanical lock-up system is released so that the printing plate carrying the old image can be removed and discarded and a newly imaged printing plate can be positioned and locked into place for the next print run.

In the past, press-ready lithographic printing plates have been prepared off-press by forming the required ink receptive image areas (and water receptive non-image areas) on suitable printing plate surfaces in a manner similar to photographic development. Preparation can be by means of hand operation or by readily available automatic developing and processing machines. Once having been imaged, printing plates generally are hand carried to the vicinity of the printing press and attached to the printing cylinder by press operators using a lock-up mechanism built into the cylinder itself. Although the attachment of the printing cylinder is generally a manual operation, robotic means have been developed for positioning and securing the printing plates.

Operations involving off-press imaging and manual mounting of printing plates are relatively slow and cumbersome. On the other hand, high speed information processing technologies are in place today in the form of pre-press composition systems which can electronically handle all the data required for directly generating the images to be printed. Almost all large scale printing operations currently utilize electronic pre-press composition systems that provide the capability for direct digital proofing, using video displays and visible hard copies produced from digital data, text and digital color separation signals stored in computer memory. These pre-press composition systems can also be used to express page-composed images to be printed in terms of rasterised, digitized signals. Consequently, conventional imaging systems in which the printing images are generated off-press on a printing plate that must subsequently be mounted on a printing cylinder present inefficient and expensive bottle-necks in printing operations.

On-press imaging is a method of generating the required image directly on the plate or printing cylinder. Existing on-press imaging systems can be divided into two types. In the first type a blank plate is mounted on the press and imaged once, thus requiring a new plate for each image. An example of this technology is the well known Heidelberg Model GTO-DI, manufactured by the Heidelberg Druckmaschinen AG (Germany) which is described in detail in U.S. Pat. No. 5,339,737. The major advantage compared to off-press plate making is much better registration between printing units when printing color images. A drawback of this method is the need to use a new plate for each image, thus increasing the cost of printing.

With press imaging systems that use plates, whether imaged off-press or on-press, the mounting cylinder is split so that clamping of the ends of the plate can be effected by a clamping means that passes through a gap in the cylinder and a slit between the juxtaposed ends of the plate. The gap in the mounting cylinder causes the cylinder to lose its rigidity and to make it susceptible to deformation and vibration. The vibration causes noise and wears out the bearings. The gap in the ends of the plate also leads to paper waste.

The second type of on-press imaging system uses the difference in the affinity to ink and water between two surfaces to define an image. One of these surfaces can be the surface of a cylinder (which could be treated to enhance certain properties) and a thin layer deposited on the cylinder having properties different than those of the cylinder surface. An example of this type is disclosed in U.S. Pat. No. 4,718,340 which teaches a hydrophilic cylinder coated with a thin layer of a hydrophobic liquid. The hydrophobic liquid is subsequently selectively ablated by a laser to generate the desired image pattern which is subsequently coated with ink. Alternatively, a hydrophobic cylinder may be coated by a hydrophilic layer and the latter layer selectively ablated. A disadvantage of this system is the low durability of the liquid layer. A refinement of this idea which overcomes the low durability of a liquid layer, is disclosed in U.S. Pat. No. 5,129,321 which teaches a method of coating a hydrophilic cylinder with a hydrophobic substance. The substance is fused to the cylinder to increase its durability. The fusing can take place before or after selectively ablating the substance coating the cylinder in accordance with digital data. After printing, the cylinder is cleaned, re-coated and re-imaged. While the latter method overcomes the limitation of U.S. Pat. No. 5,339,737 and avoids the requirement for a new plate each time the image is changed, it has not been commercially successful due to the great difficulty in completely cleaning off the substance coating the cylinder before application of a new coating. In any system which relies on the cylinder surface and the coating having opposite properties, such as hydrophilic and hydrophobic, the slightest trace of the coating left after cleaning will render the surface of the cylinder non-functional. Moreover, any cleaning based on wiping with solvents results in dissolved coating contaminating the solvent. Cleaning with this contaminated solvent results in a thin layer of the coating being left on the cylinder after cleaning. Since the properties affecting chemical affinity are related to surface properties, even a monolayer (a layer of one molecule in thickness) left behind will display opposite properties than a perfectly clean cylinder.

A second cleaning method disclosed in U.S. Pat. No. 4,718,340, which uses the imaging laser to clean the surface of the cylinder by ablation, is not practical. As the cylinder is typically made of metal or a ceramic material to withstand repeated laser exposure, it has a high heat conductivity. When the remaining thickness of the coating approaches a monolayer, most of the heat of the laser is absorbed directly in the cylinder and the surface temperature is not sufficient to drive off the coating. Adding light absorbing dye to the coating is of little use since all dyes are almost transparent at such thin layers.

It is an object of this invention to provide a reusable surface without the need for perfect cleaning, by using a method tolerant to any residual coating left on the cylinder after cleaning. It is another object of the present invention to use a seamless cylinder in order to reduce vibration and torsional resonances, achieve a faster changeover when changing from one image to another, to achieve better registration, to print at higher speeds and to eliminate the printing gap on paper caused by the separation between ends of the plate when using imaged printing plates. It is yet another object of the invention to reduce the time it takes to clean and re-image the surface of the cylinder. It is yet another object of the present invention to produce a compact design requiring access only to a small part of the cylinder circumference, thus making the invention easy to integrate into existing printing press designs. Other objects and advantages of the present invention will become apparent by considering the following description in conjunction with the drawings.

SUMMARY OF THE INVENTION

The invention relies on the fact that lithographic printing depends only on the surface properties of the printing surfaces. It is for this reason that it is necessary to modify the hydrophilic or hydrophobic properties of only an exceedingly thin layer on the surface in order to selectively attract printing ink. This enables less than perfect cleaning of a re-usable printing surface as long as the top layer of the newly applied coating is not contaminated. In conventional printing plate technology the substrate, typically anodized aluminum, has to be cleaned of any trace of the hydrophobic layer after plate processing. It is possible, however, to modify the hydrophobic properties of a polymer surface using the intense heat of laser radiation. The polymer layer can be applied on top of a partially cleaned surface without degrading the surface quality. The method can be used for waterless offset as well, using polymers capable of repelling ink, such as silicones, but which are still capable of being cleaned.

According to the invention there is provided a direct-to-press imaging lithographic printing press for imaging a pattern on the press, which includes an imaging cylindrical surface upon which image patterns are formed, a coating unit mounted proximate the imaging cylindrical surface so as to traverse the cylindrical surface and coat the surface with a thin layer of convertible material whose surface is or portions thereof are convertible from one having a first water responsive property to one having an opposite water responsive property. A convertible material curing unit is mounted proximate the imaging cylindrical surface for curing the convertible material coating after initial application to the imaging cylinder. A convertible material imaging means is used for imaging the convertible material coating over the imaging cylindrical surface so as to form a desired pattern of ink carrying areas and ink repellent areas thereon. Means for coating the convertible material coating with ink are provided. A blanket cylinder is in contact with the imaging cylinder so as to transfer the inked image pattern on the imaging cylinder to the blanket cylinder. A cleaning unit is mounted proximate the imaging cylindrical surface and is operative to clean off the cylinder after transfer of the image pattern to the blanket cylinder.

Preferably, the convertible material is a polymer and the polymer imaging means may be a radiation source. The radiation source may be a multi-beam laser exposure unit. The water responsive property may be one of hydrophobic and hydrophilic.

The polymer may be a tetra hydro pyranyl modified methyl acrylate diluted by a ketone solvent.

Advantageously, there may be included means for coating the polymer coating with a fountain solution after conditioning but before inking.

The radiation source may be mounted proximate the cylindrical surface and be movable so as to traverse the cylindrical surface as it rotates.

The polymer curing means may use heat, U.V. radiation or a combination of both. The imaging unit may use a multi-channel near infra-red source. Both the curing means and the imaging unit are mounted together on an assembly traversing the length of the cylinder while the cylinder rotates. This makes it possible to do the coating, curing and imaging at the same time, covering the whole surface of the cylinder in a spiral pattern. The cleaning station can be added to this assembly to clean the cylinder in a spiral fashion, however the use of conventional cleaning units, known as "blanket washers" may be an advantage. The advantage of a narrow cleaning unit co-mounted with the coating unit is the ability to selectively modify parts of the printing cylinder, for example clean, re-coat and re-image a single page out of an 8 page signature. This mode is valuable when only part of the data needs changing. Other features and advantages of the invention will become apparent when considering the preferred embodiment in conjunction with the drawings.

BRIEF DESCRIPTION OF THE DRAWINGS

The novel features believed characteristic of the invention are set forth in the appended claims. The invention itself, however, as well as other features and advantages thereof, will be best understood by reference to the description which follows read in conjunction with the accompanying drawings wherein:

DESCRIPTION OF THE PREFERRED EMBODIMENT

Figure 1:
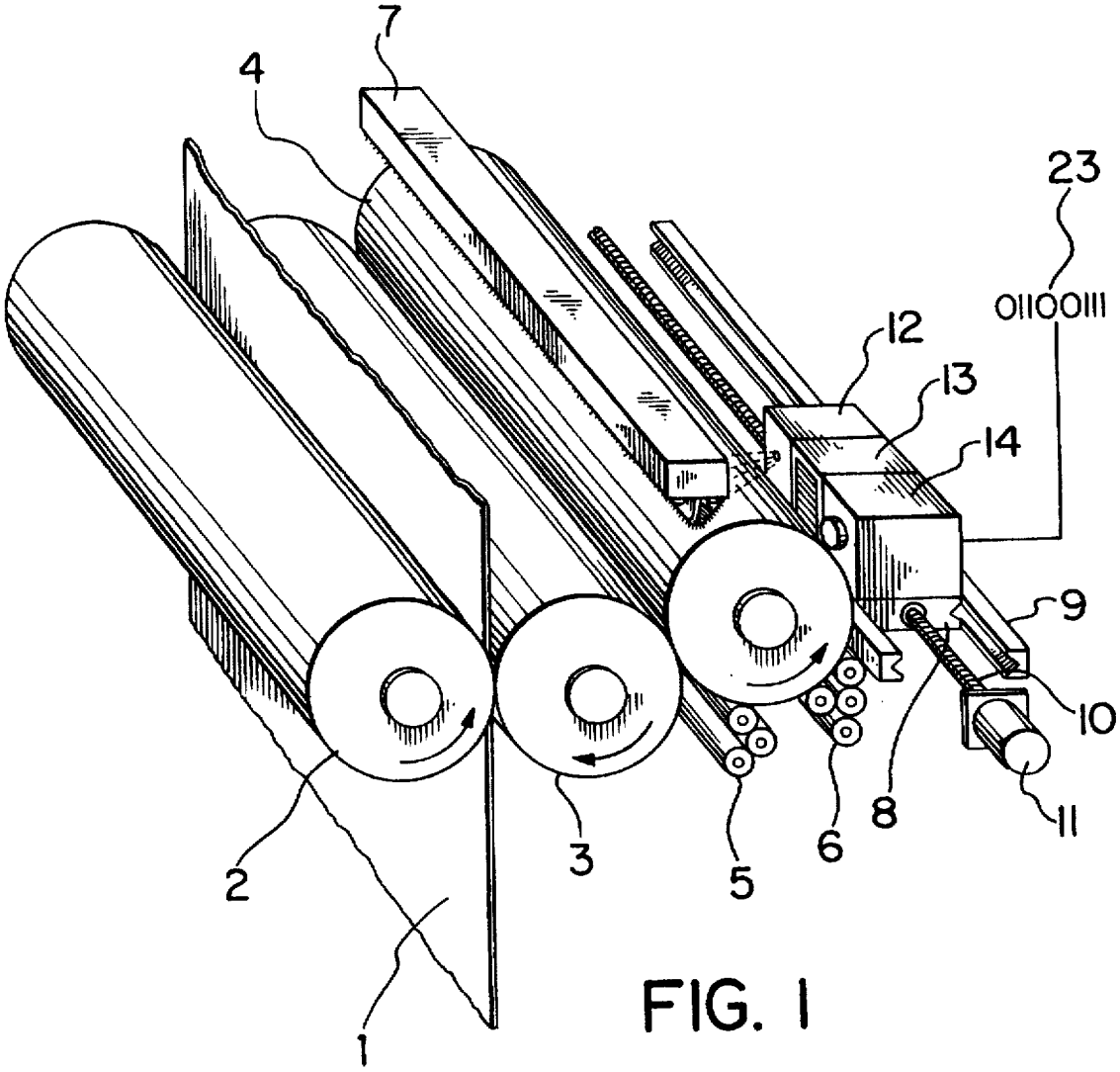
FIG. 1 is a perspective view of the printing section of a lithographic press, modified according to the invention.
Figure 2A:
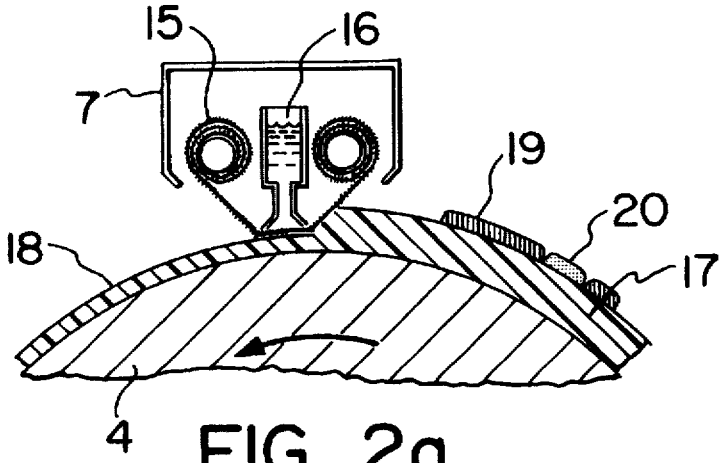
FIG. 2-*a* to 2-*e* illustrates the steps in re-imaging the surface of the printing cylinder in order to print a new signature.
Figure 2B:
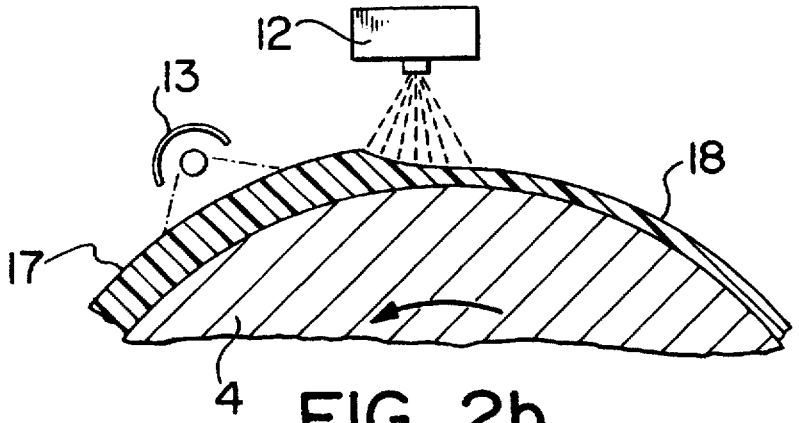
Figure 2C:
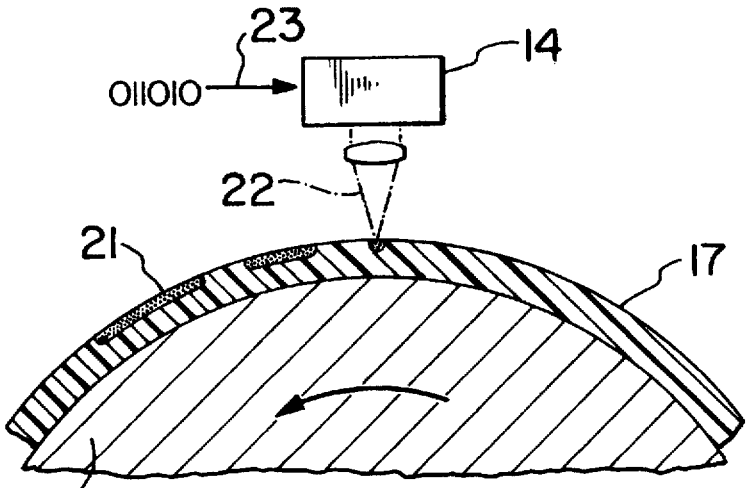
Figure 2D:
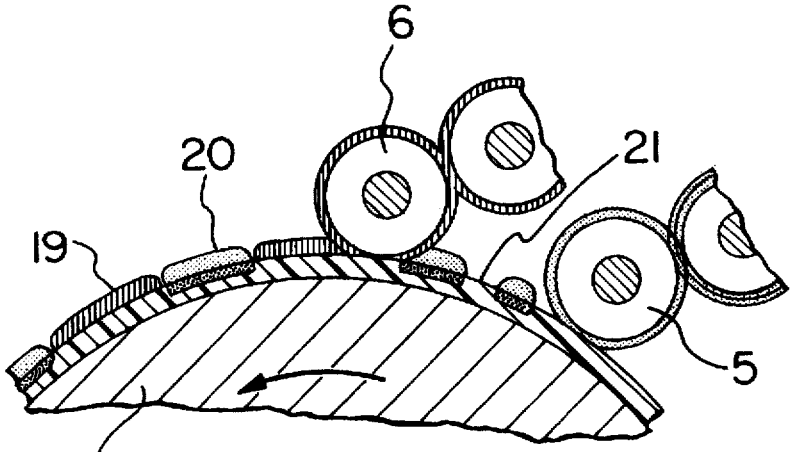
Figure 2E:
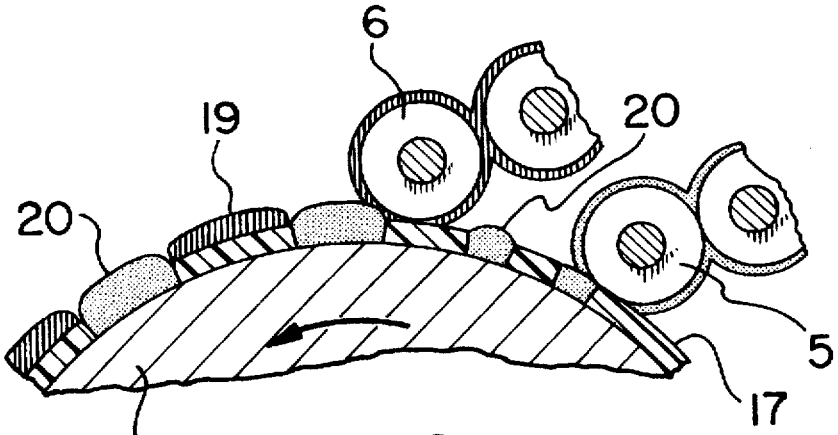

In FIGS. 1 and 2-*a* to 2-*e*, like reference numbers refer to like parts. Referring now to FIG. 1 representing the printing section of a lithographic press, paper 1 (either in sheet or web form) is compressed between impression cylinder 2 and blanket cylinder 3. Blanket cylinder 3 is in contact with image cylinder 4 which replaces the plate cylinder in a conventional press. The main difference is that image cylinder 4 is a seamless cylinder, thus being able to run faster and with no vibration compared to a plate cylinder having an elongated gap along the length of the image cylinder (not shown) for clamping the plate. The image cylinder 4 is being inked by a water/ink system using fountain solution rolls 5 and ink rolls 6. Rolls 5 and 6 will be merged in some inking systems known as "integrated" inking chain. Alternatively, the press can operate in waterless offset (also known as "dry offset") mode in which fountain solution rolls 5 are not used. Up to this point the press is conventional and well known. A cleaning unit 7 is mounted near image cylinder 4 and is capable of washing off most of the ink, water and imaged layer used on a previous print run. The cleaning unit is similar to the well known "blanket washer" units employed in modern presses to clean the blanket cylinder between print runs, with the exception that extra solvents may have to be added to dissolve most of the imaged layer. Additional cleaning units can be used to clean blanket cylinder 3 and other cylinders in accordance with modern press design.

A linear track 9 is rigidly mounted parallel to image cylinder 4. A traveling carriage 8 is traversing image cylinder 4 under the control of motor 11 and lead screw 10. The motion of image cylinder 4 and motor 11 are synchronized using shaft encoders in a manner similar to all drum imaging devices. Drum imaging devices are well known and have been commercially available for many years. Thus, no further details of the synchronization and handling of the image data will be given. A coating unit 12, curing unit 13 and imaging unit 14 are mounted on carriage 8 and capable of traversing the full width of image cylinder 4. Coating unit 12 sprays a polymer solution onto image cylinder 4, after the image cylinder 4 has been cleaned. Alternatively the polymer can be applied by a roll, similar to ink application. As the polymer has to be imaged a short time after its deposition (typically less than one minute), the curing of the liquid polymer into a solid is accelerated. The curing is accelerated by heat, either radiant or hot air, generated by curing unit 13. Use of U.V. light to accelerate curing is also possible but less desirable as U.V. curing generates cross-linked polymers which are harder to clean by cleaning unit 7. The thickness of the polymer layer is from 1 to 10 microns typically, thus the amount of material to be cured is small and energy required for curing is low, even for rapid curing.

After curing the polymer surface is imaged by a multi-channel laser head 14. In order to image the complete surface of image cylinder 4 in a short time (in the order of one or two minutes) a large number of beams are required as well as a relatively high power. Multi-beam laser imagers are well known. By the way of example, a laser array is described in U.S. Pat. No. 4,743,091 which is incorporated herein by reference. The number of beams required depends on the required imaging time, power, and the maximum rotational speed of the image cylinder 4. While the cleaning, coating and imaging is done, the press is in the "impression off" mode. In this mode the image cylinder 4 does not touch any of the other cylinders (same as a plate cylinder in "impression off" mode). After imaging the press is switched to "impression on" mode and the image cylinder 4 is inked in the conventional or waterless offset manner. A detailed explanation of the steps is shown in FIG. 2-*a* to FIG. 2-*e*.

Referring now to FIG. 2-*a* the old image, consisting of polymer coating 17 which is cured and covered with ink 19 and, in conventional offset, water 20, is cleaned by a conventional automatic blanket washer 7 (normally used to clean blanket cylinders). The blanket washer consists of a renewable wiping material 15, usually fed from one roll to another, and a solvent 16 used to wet the roll. Since the cylinder itself is immune to solvents and, typically made of metal, any suitable solvent capable of dissolving the old ink and the imaged polymer can be used. The cleaning need not be perfect and a very thin layer of residual polymer coating 18 mixed with some ink is assumed to stay on the image cylinder 4. Repeated cleaning can reduce the thickness of residual polymer coating 18 but not eliminate it, as the solvent is contaminated with the ink and polymer. Fortunately, a very thorough cleaning is not required and as long as residual polymer coating 18 is much thinner than original layer of cured polymer coating 17 the process can be used repeatedly without build-up of the layers.

Referring now to FIG. 2-*b*, a new polymer coat 17 is applied over the residue of the residual polymer coating 18 by a coating unit 12 which is equipped with a spray nozzle. Alternatively the coat can be applied with a roller or any other of the common methods. Typically the polymer is a thermoplastic material and is diluted with a solvent. Curing unit 13 uses radiative heat to evaporate the solvent and harden polymer coating 17. In the alternative, hot air or U.V. radiation can be used to cure polymer coating 17. Either linear or cross-linked polymers can be used, the disadvantage of cross-linked polymers is the relative difficulty of cleaning. When waterless printing is used most of the effective oil repelling materials are cross-linked. The thickness of polymer coating 17 is typically from 2 to 10 microns but layers as thin as 1 micron can be used if their durability is sufficient.

Referring now to FIG. 2-*c*, the cured polymer is selectively addressed by a multi-channel laser head 14 according to the pre-press data files 23. Preferably, the reaction is purely thermal, so that any type of laser can be used. Laser diodes operating in the near infra-red are the preferred source. Typically the cylinder is imaged at a resolution of 2400 DPI. Lowering the resolution does not reduce the imaging time in most cases as the process is limited by the amount of energy required, not the data rate. For conventional printing the polymers tested required between 0.1 $J/cm^2$ to 0.2 $J/cm^2$ while for waterless printing, energy requirements were 0.4 $J/cm^2$ to 0.8 $J/cm^2$. When a laser supplying 10 W is used on an 8 page press (80 cm×100 cm signature size) the time required to expose the image varies from (80 cm×100 cm×0.1 $J/cm^2$) : 10 W=80 sec for the best case, up to (80 cm×100 cm×0.8 $J/cm^2$): 10 W=640 sec for the worst case, using the lowest sensitivity waterless printing polymer. Thus, these times can only be shortened by having a more powerful head and typically are not limited by the data rate of the pre-press system. The laser beam 22 modifies the polymer from hydrophobic to hydrophilic and/or from non-soluble in water to soluble in water. The polymer is mixed with a large amount of carbon black or laser absorbing dye in order to absorb most of the laser energy in a thin layer, typically 1–2 micron. The temperature in this layer reaches easily 600° C. and sometimes higher thus the chemical composition is easily modified. The modified surface, layer 21 has as different an affinity to ink and water as possible from the unmodified polymer coating 17. To print, the press is switched to "impression on" mode, causing the image cylinder to engage the blanket cylinder and the inking system. Referring now to FIG. 2-*d*, fountain solution roll 5 applies fountain solution 20 (water) to the hydrophilic areas followed by ink rolls 6 applying ink 19 to the hydrophobic areas. Since the polymer coating 17 is not very durable in the modified areas 21, when it wears through to the image cylinder 4 the surface of the image cylinder 4 has to have a hydrophilic surface such as anodized aluminum.

In the alternate embodiment, waterless offset, the fountain solution and rolls 5 are not used. A second alternate embodiment uses integrated inking. In an integrated inking system an ink/water emulsion is applied. From that point on, the printing proceeds in a conventional manner until the printed material has to be changed. For multi-color printing, multiple press units are used. The on-press imaging has much improved color registrations as all registration errors caused by plate mounting are eliminated.

Referring to FIG. 2-*e*, the modified parts of the polymer coating 17 can be made soluble in the fountain solution 20 while still being hydrophilic, so that the fountain solution rapidly dissolves the polymer underneath it until the fountain solution extends down to the surface of the seamless image cylinder 4. Additives can be added to the fountain solution to enhance its ability to dissolve the modified polymer. Provided the material of the cylinder itself is hydrophilic, water will coat the surface of the cylinder and remain interspersed between hydrophobic areas of the polymer. Materials which are hydrophilic and suitable for the seamless cylinder are anodized aluminum, chrome, nickel, steel, and ceramics such as alumina ($Al_2O_3$) and zirconia ($ZrO_2$). Zirconia is particularly desirable as it is very durable, hydrophilic and refractory while having a low thermal conductivity. Low thermal conductivity minimizes the amount of laser energy required to heat up polymer coating 17 in order to induce the chemical transformation. Since the modified polymer is hydrophilic and the cylinder surface is hydrophilic, no change in printing is noticeable as the coating wears away.

Many different polymer compositions can be used since most polymers are hydrophobic and many turn hydrophilic (or less hydrophobic) when heated to a temperature sufficient to decompose them. Most polymers do not absorb well in the infra-red spectrum and a suitable absorbing dye, or carbon black, has to be mixed with the polymer. A suitable selection of absorbing dyes is given in U.S. Pat. No. 5,126,760 which is incorporated herein by reference. When a longer wavelength laser, such as a $CO_2$ laser, is used the absorbing dyes are not required.

In the preferred embodiment the polymer is a tetra hydro pyranyl modified methyl acrylate. It is available from the 3M corporation (Minn.). The polymer switches from hydrophobic to hydrophilic when heated up by a laser and becomes water soluble at the same time. A detailed discussion on the composition and properties of these polymers is presented in U.S. Pat. Nos. 5,102,771, 5,225,316 and 5,314,785 which are also incorporated herein by reference. The polymer is soluble in many organic solvents, particularly ketones.

Example: Conventional Offset Press Application

The polymer used is 3M thermal plate coating available from the printing plate division of 3M (Minn., U.S.A.). This coating is already pre-mixed with the infrared absorbing dye and the solvent. It is a tetra hydro pyranyl modified methyl acrylate diluted by a ketone solvent. Acetone is added to the blanket washer solvent. The imaging head used is a Creo Thermal Head (from Creo Products Inc., B.C. Canada). The head is a 240 channel head having an output power of 18 W. The imaging sensitivity for a print run length of over 50,000 impressions was found to be 0.15 J/cm$^2$. Imaging time was about 1 minute for a 80 cm×100 cm area. (80 cm circumference, 100 cm length).

The resolution was 2400 DPI and the data rate about 15 MB/sec. The imaging drum rotated at about 400 RPM during imaging.

While a laser is the preferred source, broad area light sources such as arc lamps can be used, in conjunction with light valves, to supply the required radiation. In this case the photonic effect of the radiation can be used to an advantage beyond the heating effect. By way of example, ultra violet light may be used to activate cross-linking of a polymer to render the ink carrying areas non-soluble.

Whether the polymer is made soluble or not, perfect cleaning is not required as the new layer will be contaminated very slightly by the old layer. For example, the layer left behind after using a blanket washer is 1 to 5 nm thick while the thickness of the new coat is 1 to 10 microns. Thus, the contamination is under 0.1%, which does not materially affect the properties of the layer.

While the preferred coating is a polymer, any convertible material capable of rapid curing and whose surface can be selectively converted from either hydrophilic or hydrophobic to either hydrophobic or hydrophilic, respectively, would work.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A direct-to-press imaging lithographic priming press for imaging a pattern on the press, comprising:

(a) an imaging cylindrical surface upon which inked image patterns are formed;

(b) a coating unit mounted proximate said imaging cylindrical surface;

(c) a thin layer of convertible material formed on the cylindrical surface by the coating unit and that is at least partially convertible from a material having a first water responsive property to a material having a water responsive property opposite to said first water responsive property;

(d) a convertible material curing unit mounted proximate said imaging cylindrical surface operative to condition said convertible material until it is cured;

(e) a material conversion device mounted proximate the imaging cylindrical surface and operable to convert selected portions of said convertible material coating from the first water responsive property to the opposite water responsive property so as to form a desired pattern of ink carrying areas and ink repellent areas thereon;

(f) an ink application unit mounted proximate the imaging cylindrical surface and configured to apply ink to said convertible material coating so as to form an inked image thereon;

(g) a transfer system mounted proximate the imaging cylindrical surface and configured to transfer the inked image to paper; and (h) a cleaning unit mounted proximate said imaging cylindrical surface and operative to clean off said imaging cylindrical surface including at least a substantial portion of said convertible material after transfer of the inked image to said paper.

2. A printing press according to claim 1, wherein said water responsive properties of said coating are those of being hydrophobic and hydrophilic.

3. A printing press according to claim 2, wherein said printing press is an offset printing press, said convertible material is a polymer, and said transfer system includes a blanket cylinder mounted to contact said imaging cylindrical surface so as to transfer the inked image on said imaging cylindrical surface to said blanket cylinder.

4. A printing press according to claim 3, wherein said polymer is a tetra hydro pyranyl modified methyl acrylate diluted by a ketone solvent.

5. A printing press according to claim 3, including means for coating said polymer coating with a fountain solution after converting but before inking.

6. A printing press according to claim 3, wherein said material conversion device includes a radiation source.

7. A printing press according to claim 6, wherein said radiation source is coupled to a track mounted proximate said cylindrical surface and moves so as to traverse the cylindrical surface as said cylindrical surface rotates.

8. A printing press according to claim 6, wherein said radiation source, said coating unit and said curing unit are mounted on a carriage on a lead screw and move in response to rotation of said lead screw along the length of said imaging cylindrical surface.

9. A printing press according to claim 6, wherein said radiation source is a multi-beam laser head.

10. A printing press according to claim 9, wherein said imaging cylindrical surface is seamless.

11. A printing press according to claim 1, wherein said water responsive properties of said coating are those of being water soluble and water insoluble.

12. A priming press according to claim 1, wherein said transfer system includes a blanket cylinder having a compressible surface.

13. A priming press according to claim 1, wherein said coating unit includes a spray unit that is coupled to a track proximate said image cylindrical surface and configured to move on the track across the surface thereof.

14. A direct-to-press imaging lithographic printing press for imaging a pattern on the press, comprising:

(a) an imaging cylindrical surface upon which image patterns are formed;

(b) a coating unit mounted proximate said imaging cylindrical surface;

(c) a thin layer of convertible material formed on the cylindrical surface by the coating unit and that is at least partially convertible from a material having a first oil responsive property to a material having an oil responsive property opposite to said first oil responsive property;

(d) a convertible material curing unit mounted proximate said imaging cylindrical surface operative to condition said convertible material until it is cured;

(e) a material conversion device mounted proximate the imaging cylindrical surface and operable to convert selected portions of said convertible material coating from the first oil responsive property to the opposite oil responsive property so as to form a desired pattern of ink carrying areas and ink repellent areas thereon;

(f) an ink application unit mounted proximate the imaging cylindrical surface and configured to apply ink to said convertible material coating so as to form an inked image thereon;

(g) a transfer system mounted proximate the imaging system and configured to transfer the inked image to paper;

(h) a cleaning unit mounted proximate said imaging cylindrical surface and operative to clean off said imaging cylindrical surface including at least a substantial portion of said convertible material after transfer of the inked image to said paper; and (i) wherein said priming press is a waterless offset printing press, said convertible material is a polymer that is silicone based, and said transfer system includes a blanket cylinder mounted to contact said imaging cylindrical surface so as to transfer the inked image on said imaging cylindrical surface to said blanket cylinder.

15. A direct-to-press imaging method for a lithographic offset printing press having an image cylinder upon which images may be formed, comprising:

(a) cleaning said image cylinder;

(b) applying a thin coating of a convertible material to a cylindrical surface of said image cylinder, said convertible material being capable of changing its affinity to oil and water in response to converting its surface;

(c) curing said convertible material so that it becomes solid;

(d) converting the surface of said convertible material so as to create an image pattern thereon according to data to be printed;

(e) lithographic offset printing of the data imaged on said convertible material surface using the different affinities for printing ink of the converted and non-converted areas to define ink carrying areas, without using the properties of the material of said image cylinder in the printing process and (f) when the data to be printed needs to be changed, cleaning the image cylinder on press by removing at least a substantial portion of said convertible material after printing of the data imaged on said convertible material surface.

16. A method according to claim 15, wherein said printing step is done by wet offset printing.

17. A method according to claim 15, wherein the convertible material is a polymer.

18. A method according to claim 17, wherein said converting step comprises irradiating said polymer surface.

19. A method according to claim 18, wherein said irradiating step is done by a multi-beam laser exposure unit.

20. A method according to claim 18, including mixing the polymer with laser absorbing dye prior to applying the thin coating.

21. A method according to claim 17, wherein said image cylinder is seamless.

22. A method according to claim 17, wherein said polymer is a tetra hydro pyranyl modified methyl acrylate diluted by a ketone solvent.

23. A method according to claim 17, wherein said curing step involves heating the surface of said polymer coating.

24. A method according to claim 17, wherein the thickness of the polymer coating is in the range of 1 to 10 microns.

25. A method according to claim 17, including mixing the polymer with carbon black prior to applying the thin coating.

26. The method of claim 15 further comprising carrying out the operations of clauses (b) through (f) without removing the cylinder from the press.

27. The method of claim 26 further comprising carrying out the operations of clauses (b) through (f) while the cylinder is rotating in the press.

28. The method of claim 26 further comprising carrying out the operations of clauses (a) through (f) while the cylinder is rotating in the press.

29. A direct-to-press imaging method for a lithographic offset printing press having an image cylinder upon which images may be formed, comprising:

(a) cleaning said image cylinder;

(b) applying a thin coating of a convertible material to a cylindrical surface of said image cylinder, said convertible material being one of hydrophobic or hydrophilic and said cylindrical surface being the other of hydrophilic or hydrophobic, and said convertible material being capable of changing its solubility in fountain solution;

(c) curing said convertible material so that it becomes solid;

(d) selectively converting portions of said convertible material so as to change its solubility in fountain solution and to create an image pattern thereon according to data to be printed, said image pattern being defined at least in part by the converted portions of the convertible material; and (e) coating said convertible material with fountain solution so as to dissolve the portions thereof that are soluble and to define areas on the image cylinder having different affinities for printing ink;

(f) coating the image cylinder with ink to create an inked image pattern defined by the areas on the image cylinder having different affinities for printing ink;

(g) lithographic offset printing the inked image pattern, and (h) repeating all the above steps each time the data to be printed needs to be changed.

30. A method according to claim 29, wherein the convertible material is a polymer, the image cylinder surface is hydrophilic and the undissolved areas of the coating are hydrophobic.

31. A method according to claim 29, wherein said converting operation comprises irradiating said convertible material with laser light from a multi beam laser head.

32. A method according to claim 29, wherein said convertible material is a polymer comprised of a tetra hydro pyranyl modified methyl acrylate diluted by a ketone solvent.

33. The method of claim 29 wherein the cleaning operation comprises removing at least a portion of the convertible material after printing of the data imaged on the surface of the convertible material.

34. The method of claim 33 further comprising carrying out the operations of clauses (a)–(h) without removing the cylinder from the press.

35. The method of claim 33 further comprising carrying out the operations of clauses (a) through (h) while the cylinder is mounted in the press.

36. The method of claim 33 further comprising carrying out the operations of clauses (a) through (h) while the cylinder is rotating in the press.

37. A direct-to-press imaging lithographic printing press for imaging a pattern on the press, comprising:

(a) an imaging cylinder rotatably mounted on the press and including an imaging surface;

(b) a supply of convertible material, the convertible material being at least partially convertible from a material having a first water responsive property to a material having a water responsive property opposite to said first water responsive property;

(c) a coating unit mounted on the press proximate said imaging cylinder and coupled to the supply of convertible material, the coating unit including a dispenser configured to coat the imaging surface of the cylinder with a thin layer of the convertible material;

(d) a curing unit mounted on the press proximate the surface of the imaging cylinder, the curing unit being operative to condition said convertible material until it is cured;

(d) a material conversion device mounted on the press proximate the imaging cylinder and including a source of either heat or radiation, the conversion device being configured to direct the heat or radiation to convert selected portions of the thin layer of convertible material from the first water responsive property to the opposite water responsive property so as to form a desired pattern of ink carrying areas and ink repellent areas on the convertible material;

(e) an ink application unit including a source of ink and mounted on the press proximate the imaging cylinder, the ink application unit being configured to apply ink to said convertible material coating after the selected portions thereof are converted so as to form an inked image thereon;

(f) a transfer system mounted proximate the imaging cylinder and configured to transfer the inked image to paper; and (g) a selectively operable cleaning unit mounted on the press proximate the imaging cylinder and configured to clean the imaging cylinder by removing at least a portion of the convertible material after transfer of the image to the paper.

38. A printing press according to claim 37, wherein the printing press is an offset printing press, the convertible material is a polymer, and the transfer system includes a blanket cylinder mounted to contact the imaging cylinder so as to transfer the inked image to the blanket cylinder.

39. A printing press in accordance with claim 37 wherein the convertible material comprises a thermally activated material including a polymer, the coating unit applies the thin coating of convertible material in liquid form, and the material conversion device selectively heats the polymer and causes it to undergo a non-reversible transformation in ink affinity.

40. A printing press in accordance with claim 39 wherein the polymer is applied to form a layer 1 to 10 microns thick.

41. A direct-to-press lithographic method for imaging a pattern on a printing press, comprising:

(a) rotatably mounting on the press an imaging cylinder that includes an imaging surface;

(b) applying a thin layer of convertible material on the imaging surface, the convertible material being at least partially convertible from a material having a first ink responsive property to a material having a second ink responsive property opposite to said first ink responsive property;

(c) curing the layer of convertible material applied to the imaging surface;

(d) selectively directing heat or radiation at the layer of convertible material to convert selected portions of the thin layer of convertible material from the first ink responsive property to the second ink responsive property so as to form an image comprised of a desired pattern of ink carrying areas and ink repellent areas;

(e) applying ink to said convertible material after the selected portions of the convertible material are converted so as to form an inked image on at least a portion of the convertible material;

(f) transferring the inked image from the convertible material to paper;

(g) when it is desired to change the image formed on the convertible material, cleaning the imaging cylinder by removing at least a portion of the convertible material after transfer of the inked image to the paper; and (h) carrying out the operations of clauses (b) through (g) without removing the cylinder from the press.

42. The method of claim 41 further comprising carrying out the operations of clauses (b) through (g) while the cylinder is rotating in the press.

43. The method of claim 42 wherein applying the thin layer of convertible material includes controlling a spray unit mounted proximate the imaging cylinder so that it traverses the imaging surface.

44. The method of claim 41 wherein the convertible material comprises a thermally activated material including a polymer, the thin coating of convertible material is applied in liquid form, and the operation of selectively heating the polymer causes it to undergo a non-reversible transformation in ink affinity.

45. The method of claim 44 wherein the polymer is a tetra hydro pyranyl modified methyl acrylate diluted by a ketone solvent.

46. The method of claim 44 further comprising coating the polymer coating with a fountain solution after converting but before inking.

47. The method of claim 44 wherein the polymer is silicone based, and transferring the inked image includes using a blanket cylinder to contact the imaging cylinder so as to transfer the inked image to the blanket cylinder using waterless offset printing.

48. The method of claim 41 wherein the convertible material comprises a thermoplastic material diluted with a solvent and applied to form a layer 1 to 10 microns thick.

49. The method of claim 41 wherein the ink responsive properties of the convertible material are those of being hydrophobic and hydrophilic.

50. The method of claim 41 wherein the ink responsive properties of the convertible material are those of being water soluble and water insoluble.

51. The method of claim 41 wherein the operation of selectively directing heat or radiation at the layer of convertible material includes controlling a source of radiation.

52. The method of claim 51 wherein the source of radiation comprises a multi-beam laser head.

53. The method of claim 51 wherein controlling the radiation source includes moving the source to traverse the imaging surface of the cylinder.

54. The method of claim 51 wherein applying the thin layer of convertible material includes controlling a spray unit, and wherein the radiation source and spray unit are mounted side-by-side on a lead screw and are controlled to move in response to rotation of said lead screw over and along at least a portion of the length of the imaging surface.

55. The method of claim 41 wherein the imaging surface is seamless.

56. The method of claim 41 wherein the operations of clauses (e) and (f) comprise wet offset printing.

57. A direct-to-press imaging method for a lithographic offset printing press having an image cylinder upon which images may be formed, comprising:

(a) cleaning said image cylinder;

(b) applying a thin coating of a convertible material to a cylindrical surface of said image cylinder, said convertible material being capable of changing its affinity to oil in response to converting its surface;

(c) curing said convertible material so that it becomes solid;

(d) converting the surface of said convertible material so as to create an image pattern thereon according to data to be printed; and (e) lithographic offset printing of the data imaged on said convertible material surface using the different affinities for printing ink of the converted and non-converted areas to define ink carrying areas, without using the properties of the material of said image cylinder in the printing process;

(f) cleaning the image cylinder on press by removing at least a substantial portion of said convertible material after printing of the data imaged on said convertible material surface; and (g) wherein the lithographic printing step is waterless offset.

58. A method according to claim 57, wherein the convertible material is a polymer that is silicone-based.

59. The method of claim 57 further comprising carrying out the operations of clauses (b) through (f) without removing the cylinder from the press.

60. The method of claim 59 further comprising carrying out the operations of clauses (b) through (f) while the cylinder is rotating in the press.

* * * * *

UNITED STATES PATENT AND TRADEMARK OFFICE

CERTIFICATE OF CORRECTION

PATENT NO : 5,713,287
DATED : February 3, 1998
INVENTOR(S) : Daniel Gelbart

It is certified that error appears in the above-identified patent and that said Letters Patent are hereby corrected as shown below:

Column 8, line 16 and col. 9, lines 17, 20, and 58, change "priming" to --printing--.

Signed and Sealed this

Second Day of June, 1998

*Attest:*

Bruce Lehman

BRUCE LEHMAN

*Attesting Officer*

*Commissioner of Patents and Trademarks*

US005713287C1

(12) REEXAMINATION CERTIFICATE (4792nd)

United States Patent

Gelbart

(10) Number: US 5,713,287 C1

(45) Certificate Issued: Jun. 3, 2003

(54) DIRECT-TO-PRESS IMAGING METHOD USING SURFACE MODIFICATION OF A SINGLE LAYER COATING

(75) Inventor: Daniel Gelbart, Vancouver (CA)

(73) Assignee: Creo Products Inc., Burnaby (CA)

Reexamination Request:
No. 90/006,084, Jun. 4, 2001

Reexamination Certificate for:

| | |
|---|---|
| Patent No.: | **5,713,287** |
| Issued: | **Feb. 3, 1998** |
| Appl. No.: | **08/490,361** |
| Filed: | **Jun. 14, 1995** |

Certificate of Correction issued Feb. 3, 1998.

Related U.S. Application Data

(63) Continuation-in-part of application No. 08/438,817, filed on May 11, 1995, now abandoned.

(51) Int. Cl.[7] ..... B41N 1/14

(52) U.S. Cl. ..... 101/467; 101/478

(58) Field of Search ..... 101/453, 456, 101/457, 460, 462, 463.1, 465–467, 470, 471, 478, 401.1; 430/270

(56) References Cited

U.S. PATENT DOCUMENTS

| | | | | | |
|---|---|---|---|---|---|
| 2,764,085 | A | * | 9/1956 | Shoemaker et al. | 101/467 |
| 3,168,864 | A | * | 2/1965 | Brandl, Jr. et al. | 101/467 |
| 3,422,759 | A | * | 1/1969 | Baynko et al. | 101/467 |
| 3,678,852 | A | * | 7/1972 | Feinleib et al. | 101/467 |
| 3,741,118 | A | * | 6/1973 | Carley | 101/451 |
| 4,063,949 | A | * | 12/1977 | Uhlig et al. | 101/471 |
| 4,081,572 | A | * | 3/1978 | Pacansky | 101/467 |
| 4,292,397 | A | | 9/1981 | Takeuchi et al. | |
| 4,634,659 | A | * | 1/1987 | Esumi et al. | 430/270 |
| 4,718,340 | A | * | 1/1988 | Love, III | 101/116 |
| 4,743,091 | A | * | 5/1988 | Gelbart | 350/352 |
| 4,833,990 | A | * | 5/1989 | Hirt et al. | 101/467 |
| 4,872,962 | A | * | 10/1989 | Scheer et al. | 101/467 |
| 4,965,322 | A | * | 10/1990 | Shimamura et al. | 430/270 |
| 5,102,771 | A | * | 4/1992 | Vogel et al. | 430/270 |
| 5,126,760 | A | * | 6/1992 | DeBoer | 346/108 |
| 5,129,321 | A | * | 7/1992 | Fadner | 101/467 |
| 5,225,316 | A | * | 7/1993 | Vogel et al. | 430/270 |
| 5,278,027 | A | * | 1/1994 | Clarke | 430/207 |
| 5,314,785 | A | * | 5/1994 | Vogel et al. | 430/269 |
| 5,339,737 | A | * | 8/1994 | Lewis et al. | 101/454 |
| 5,378,580 | A | * | 1/1995 | Leenders | 430/303 |
| 5,385,092 | A | * | 1/1995 | Lewis et al. | 101/467 |
| 5,440,987 | A | | 8/1995 | Williams et al. | |

FOREIGN PATENT DOCUMENTS

| | | | | |
|---|---|---|---|---|
| CA | 1050805 | * | 3/1979 | |
| DE | 2524701 | * | 12/1976 | 101/467 |
| DE | 3911932 A1 | | 10/1990 | |
| DE | 4341567 | | 6/1995 | |
| EP | 101266 | | 2/1984 | |
| EP | 652483 | * | 5/1995 | |
| GB | 1546532 | | 5/1979 | |
| GB | 2284684 A | | 6/1995 | |
| JP | 59-44225 | | 10/1984 | |
| JP | 1-152459 | | 6/1989 | |
| JP | 92575 | * | 4/1990 | 101/467 |
| JP | 5-77385 | | 3/1993 | |
| JP | 6-1088 | | 6/1994 | |
| JP | 7-52569 | | 2/1995 | |
| WO | 07716 | * | 5/1992 | |

OTHER PUBLICATIONS

Print World, vol. 230, No. 4, (Apr. 25, 1990).*

* cited by examiner

*Primary Examiner*—Eugene H. Eickholt

(57) ABSTRACT

A direct-to-press system using a seamless cylinder coated on the press with a curable polymer. After curing, the surface of the polymer is modified by selective laser radiation to change its affinity to printing ink. The cylinder is used is place of a plate cylinder in an offset press, either conventional or waterless. Since only the surface is selectively modified by the laser, coating thickness and uniformity are of little concern. After printing, the cylinder is cleaned on the press using a cleaning station similar to blanket washers used on presses. Cleaning does not have to be complete since the surface of the cylinder is never exposed to the ink. The system is compatible with existing press designs as it can be mounted in the space currently used to access the plate cylinder for plate changing.

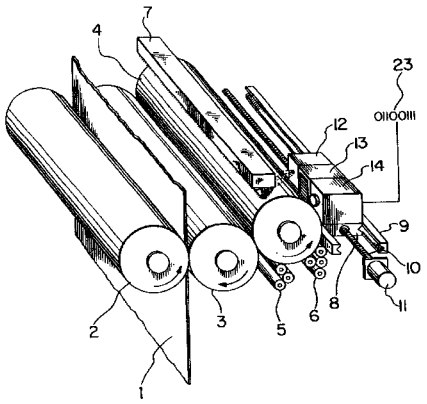

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–14 and 29–40 is confirmed.

Claims 15, 17, 41, 42, 44, 57, and 59 are cancelled.

Claims 16, 18, 20–28, 43, 45, 46, 48–51, 54–56, 58, and 60 are determined to be patentable as amended.

Claims 19, 47, 52, and 53, dependent on an amended claim, are determined to be patentable.

New claims 61–87 are added and determined to be patentable.

16. A method according to claim [15] *20*, wherein said printing step is done by wet offset printing.

18. A method according to claim [17] *22*, wherein said converting step comprises irradiating said polymer surface.

20. [A method according to claim 18, including] *A direct-to-press imaging method for a lithographic offset printing press having an image cylinder upon which images may be formed, comprising:*

(*a*) *cleaning said image cylinder;*

(*b*) *applying a thin coating of a polymer to a cylindrical surface of said image cylinder, said polymer being capable of changing its affinity to oil and water in response to converting its surface;*

(*c*) *curing said polymer so that it becomes solid;*

(*d*) *converting said surface of said polymer by irradiating said polymer surface so as to create an image pattern thereon according to data to be printed;*

(*e*) *lithographic offset printing of the data imaged on said polymer surface using the different affinities for printing ink of the converted and non-converted areas to define ink carrying areas, without using the properties of the material of said image cylinder in the printing process; and,*

(*f*) *when the data to be printed needs to be changed, cleaning the image cylinder on press by removing at least a substantial portion of said polymer after printing of the data imaged on said polymer surface;*

*wherein said method includes* mixing [the] *said* polymer with laser absorbing dye prior to applying [the] *said* thin coating.

21. A method according to claim [17] *20*, wherein said image cylinder is seamless.

22. [A method according to claim 17,] *A direct-to-press imaging method for a lithographic offset printing press*

*having an image cylinder upon which images may be formed, comprising:*

(*a*) *cleaning said image cyylinder;*

(*b*) *applying a thin coating of a polymer to a cylindrical surface of said image cylinder, said polymer being capable of changing its affinity to oil and water in response to converting its surface;*

(*c*) *curing said polymer so that it becomes solid;*

(*d*) *converting said surface of said polymer so as to create an image pattern thereon according to data to be printed;*

(*e*) *lithographic offset printing of the data imaged on said polymer surface using the different affinities for printing ink of the converted and non-converted areas to define ink carrying areas, without using the properties of the material of said image cylinder in the printing process; and,*

(*f*) *when the data to be printed needs to be changed, cleaning the image cylinder on press by removing at least a substantial portion of said polymer after printing of the data imaged on said polymer surface;* wherein said polymer is a tetra hydro pyranyl modified methyl acrylate diluted by a ketone solvent.

23. A method according to claim [17] *20*, wherein said curing step involves heating the surface of said polymer coating.

24. A method according to claim [17] *20*, wherein the thickness of the polymer coating is in the range of 1 to 10 microns.

25. A method according to claim [17] *20*, including mixing the polymer with carbon black prior to applying the thin coating.

26. The method of claim [15 further] *20* comprising carrying out the operations of clauses (b) through (f) without removing the cylinder from the press.

27. [The method of claim 26 further] *A direct-to-press imaging method for a lithographic offset printing press having an image cylinder upon which images may be formed, comprising:*

(*a*) *cleaning said image cylinder;*

(*b*) *applying a thin coating of a convertible material to a cylindrical surface of said image cylinder, said convertible material being capable of changing its affinity to oil and water in response to converting its surface;*

(*c*) *curing said convertible material so that it becomes solid;*

(*d*) *converting the surface of said convertible material so as to create an image pattern thereon according to data to be printed;*

(*e*) *lithographic offset printing of the data imaged on said convertible material surface using the different affinities for printing ink of the converted and non-converted areas to define ink carrying areas, without using the properties of the material of said image cylinder in the printing process; and,*

(*f*) *when the data to be printed needs to be changed, cleaning the image cylinder on press by removing at least a substantial portion of said convertible material after printing of the data imaged on said convertible material surface;*

*the method* comprising carrying out the operations of clauses (b) through (f) *without removing the cylinder from the press* while the cylinder is rotating in the press.

28. [The method of claim 26 further] *A direct-to-press imaging method for a lithographic offset printing press*

*having an image cylinder upon which images may be formed, comprising:*

(*a*) *cleaning said image cylinder;*

(*b*) *applying a thin coating of a convertible material to a cylindrical surface of said image cylinder, said convertible material being capable of changing its affinity to oil and water in response to converting its surface;*

(*c*) *curing said convertible material so that it becomes solid;*

(*d*) *converting the surface of said convertible material so as to create an image pattern thereon according to data to be printed;*

(*e*) *lithographic offset printing of the data imaged on said convertible material surface using the different affinities for printing ink of the converted and non-converted areas to define ink carrying areas, without using the properties of the material of said image cylinder in the printing process; and,*

(*f*) *when the data to be printed needs to be changed, cleaning the image cylinder on press by removing at least a substantial portion of said convertible material after printing of the data imaged on said convertible material surface;*

*the method* comprising carrying out the operations of clauses (a) through (f) *without removing the cylinder from the press* while the cylinder is rotating in the press.

43. [The method of claim 42] A direct-to-press lithographic method for imaging a pattern on a printing press, comprising:

a) rotatably mounting on the press an imaging cylinder that includes an imaging surface;

b) applying a thin layer of convertible material on the imaging surface, the convertible material being at least partially convertible from a material having a first ink responsive property to a material having a second ink responsive property opposite to said first ink responsive property;

c) curing the layer of convertible material applied to the imaging surface;

d) selectively directing heat or radiation at the layer of convertible material to convert selected portions of the thin layer of convertible material from the first ink responsive property to the second ink responsive property so as to form an image comprised of a desired pattern of ink carrying areas and ink repellent areas;

e) applying ink to said convertible material after the selected portions of the convertible material are converted so as to form an inked image on at least a portion of the convertible material;

f) transferring the inked image from the convertible material to paper;

g) when it is desired to change the image formed on the convertible material, cleaning the imaging cylinder by removing at least a portion of the convertible material after transfer of the inked image to the paper; and, h) carrying out the operations of clauses (b) through (g) while the cylinder is rotating in the press without removing the cylinder from the press; wherein the convertible material comprises a thermally activated material including a polymer, the thin coating of convertible material is applied in liquid form, and the operation of selectively heating the polymer causes it to undergo a non-reversible transformation in ink affinity and wherein applying the thin layer of convertible material includes controlling a spray unit mounted proximate the imaging cylinder so that it traverses the imaging surface.

45. [The method of claim 44] *A direct-to-press lithographic method for imaging a pattern on a printing press, comprising:*

(*a*) *rotatably mounting on the press an imaging cylinder that includes an imaging surface;*

(*b*) *applying a thin layer of convertible material on the imaging surface, the convertible material being at least partially convertible from a material having a first ink responsive property to a material having a second ink responsive property opposite to said first ink responsive property;*

(*c*) *curing the layer of convertible material applied to the imaging surface;*

(*d*) *selectively directing heat or radiation at the layer of convertible material to convert selected portions of the thin layer of convertible material from the first ink responsive property to the second ink responsive property so as to form an image comprised of a desired pattern of ink carrying areas and ink repellent areas;*

(*e*) *applying ink to said convertible material after the selected portions of the convertible material are converted so as to form an inked image on at least a portion of the convertible material;*

(*f*) *transferring the inked image from the convertible material to paper;*

(*g*) *when it is desired to change the image formed on the convertible material, cleaning the imaging cylinder by removing at least a portion of the convertible material after transfer of the inked image to the paper; and,*

(*h*) *carrying out the operations of clauses* (*b*) *through* (*g*) *without removing the cylinder from the press;*

*wherein the convertible material comprises a thermally activated material including a polymer, the thin coating of convertible material is applied in liquid form, the operation of selectively heating the polymer causes it to undergo a non-reversible transformation in ink affinity and* wherein the polymer is a tetra hydro pyranyl modified methyl acrylate diluted by a ketone solvent.

46. [The method of claim 44 further comprising] *A direct-to-press lithographic method for imaging a pattern on a printing press, comprising:*

(*a*) *rotatably mounting on the press an imaging cylinder that includes an imaging surface;*

(*b*) *applying a thin layer of convertible material on the imaging surface, the convertible material being at least partially converible from a material having a first ink responsive property to a material having a second ink responsive property opposite to said first ink responsive property;*

(*c*) *curing the layer of convertible material applied to the imaging surface;*

(*d*) *selectively directing heat or radiation at the layer of convertible material to convert selected portions of the thin layer of convertible material from the first ink responsive property to the second ink responsive property so as to form an image comprised of a desired pattern of ink carrying areas and ink repellent areas;*

(*e*) *applying ink to said convertible material after the selected portions of the convertible material are converted so as to form an inked image on at least a portion of the convertible material;*

(*f*) *transferring the inked image from the convertible material to paper;*

(g) *when it is desired to change the image formed on the convertible material, cleaning the imaging cylinder by removing at least a portion of the convertible material after transfer of the inked image to the paper; and,*

(h) *carrying out the operations of clauses (b) through (g) without removing the cylinder from the press;*

*wherein the convertible material comprises a thermally activated material including a polymer, the thin coating of convertible material is applied in liquid form, the operation of selectively heating the polymer causes it to undergo a non-reversible transformation in ink affinity and the method comprises* coating the polymer coating with a fountain solution after converting but before inking.

48. The method of claim [41] *46* wherein the convertible material comprises a thermoplastic material diluted with a solvent and applied to form a layer 1 to 10 microns thick.

49. The method of claim [41] *46* wherein the ink responsive properties of the convertible material are those of being hydrophobic and hydrophilic.

50. The method of claim [41] *46* wherein the ink responsive properties of the convertible material are those of being water soluble and water insoluble.

51. The method of claim [41] *46* wherein the operation of selectively directing heat or radiation at the layer of convertible material includes controlling a source of radiation.

54. The method of claim [51] *46* wherein *the operation of selectively directing heat or radiation at the layer of convertible material includes controlling a source of radiation,* applying the thin layer of convertible material includes controlling a spray unit, and wherein the radiation source and spray unit are mounted side-by-side on a lead screw and are controlled to move in response to rotation of said lead screw over and along at least a portion of the length of the imaging surface.

55. The method of claim [41] *46* wherein the imaging surface is seamless.

56. The method of claim [41] *46* wherein the operations of clauses (e) and (f) comprise wet offset printing.

58. A method according to claim [57] *60*, wherein the convertible material is a polymer that is silicone-based.

60. [The method of claim 59 further comprising] *A direct-to-press imaging method for a lithographic offset printing press having an image cylinder upon which images may be formed, comprising:*

(a) *cleaning said image cylinder;*

(b) *applying a thin coating of a convertible material to a cylindrical surface of said image cylinder, said convertible material being capable of changing its affinity to oil in response to converting its surface;*

(c) *curing said convertible material so that it becomes solid;*

(d) *converting the surface of said converible material so as to create an image pattern thereon according to data to be printed; and*

(e) *lithographic offset printing of the data imaged on said convertible material surface using the different affinities for printing ink of the converted and non-converted areas to define ink carrying areas, without using the properties of the material of said image cylinder in the printing process;*

(f) *cleaning the image cylinder on press by removing at least a substantial portion of said convertable material after printing of the data imaged on said convertible material surface;*

(g) *wherein the lithographic printing step is waterless offset; and,* carrying out the operations of clauses (b) through (f) *without removing the cylinder from the press* while the cylinder is rotating in the press.

*61. The printing press of claim 1, wherein said cleaning unit is mounted on an assembly adapted to traverse a length of the cylindrical imaging surface as the imaging cylindrical surface is rotated.*

*62. The printing press of claim 6, wherein said radiation source comprises a near-infrared radiation source.*

*63. A printing press according to claim 1, wherein said material conversion device includes a radiation source and said radiation source is movable so as to traverse said cylindrical surface as said cylindrical surface rotates.*

*64. A printing press according to claim 1, wherein said convertible material curing unit, said material conversion device and said cleaning unit are mounted together on an assembly that is movable to traverse a length of said imaging cylindrical surface.*

*65. The direct-to-press imaging lithographic printing press of claim 14, wherein the material conversion device is operable to convert selected portions of said convertible material coating from the first oil responsive property to the opposite oil responsive property by heating the selected portions.*

*66. The method of claim 20, wherein converting the surface of said polymer results in some parts of said polymer being soluble in a fountain solution.*

*67. The method of claim 20, wherein curing said polymer comprises heating said polymer to evaporate a solvent.*

*68. The method of claim 20, wherein converting said surface of said polymer comprises heating said polymer sufficiently to cause a non-reversible transformation.*

*69. The method of claim 22, wherein converting said surface of said polymer comprises heating said polymer sufficiently to cause a non-reversible transformation.*

*70. The method of claim 27, wherein converting the surface of said convertible material results in some parts of said convertible material being soluble in a fountain solution.*

*71. The method of claim 27, wherein curing said convertible material comprises heating said convertible material to evaporate a solvent.*

*72. The method of claim 27, wherein converting said surface of said convertible material comprises heating said convertible material sufficiently co cause a non-reversible transformation.*

*73. The method of claim 28, wherein converting the surface of said convertible material results in some parts of said convertible material being soluble in a fountain solution.*

*74. The method of claim 28, wherein curing said convertible material comprises heating said convertible material to evaporate a solvent.*

*75. The method of claim 28, wherein converting said surface of said convertible material comprises heating said convertible material sufficiently to cause a non-reversible transformation.*

*76. The method of claim 29, wherein selectively converting portions of said convertible material comprises heating the portions of said convertible material to a temperature at which the solubility of the convertible material in a fountain solution is changed.*

*77. The method of claim 76, wherein the image cylinder surface is hydrophilic and insoluble portions of the coating are hydrophobic.*

*78. The method of claim 76, wherein selectively converting portions of said convertible material comprises irradi-*

*ating said convertible material with laser radiation from a multi beam laser head.*

*79. The method of claim 78, wherein said laser radiation is in the near infra-red.*

*80. The method of claim 76, wherein selectively converting portions of said convertible material comprises irradiating said convertible material with laser radiation from a $CO_2$ laser.*

*81. A method according to claim 76, wherein said convertible material is a polymer comprising a tetra hydro pyranyl modified methyl acrylate diluted by a ketone solvent.*

*82. The method of claim 76, wherein said cleaning said image cylinder comprises removing at least a portion of the convertible material.*

*83. The method of claim 29, wherein said cleaning said imaging cylinder comprises removing at least a portion of the convertible material.*

*84. The method of claim 29, wherein curing said convertible material comprises heating said convertible material to evaportate a solvent.*

*85. The method of claim 29, wherein curing said convertible material comprises heating said convertible material.*

*86. The method of claim 29, wherein selectively converting portions of said convertible material comprises heating said convertible material sufficiently to cause an non-reversible transformation of said portions of said convertible material.*

*87. The method of claim 29, wherein selectively converting portions of said convertible material comprises rendering ink-carrying areas of the convertible material non-soluble.*

* * * * *